US005645480A

United States Patent [19]

Spengler

[11] Patent Number: 5,645,480

[45] Date of Patent: Jul. 8, 1997

[54] CLEAN AIR FACILITY

[76] Inventor: Charles W. Spengler, 3024 W. Prospect, Fort Collins, Colo. 80526

[21] Appl. No.: 431,805

[22] Filed: May 1, 1995

[51] Int. Cl.[6] ..... F24F 7/007

[52] U.S. Cl. ..... 454/187; 55/385.2; 55/473

[58] Field of Search ..... 454/187; 55/385.2, 55/470, 473; 135/105

[56] References Cited

U.S. PATENT DOCUMENTS

| | | | |
|---|---|---|---|
| 3,824,909 | 7/1974 | Horneff et al. | 454/18 |
| 4,304,224 | 12/1981 | Fortney | 454/187 X |
| 4,331,128 | 5/1982 | Gebhardt | 126/417 |
| 4,706,551 | 11/1987 | Schofield | 135/156 X |
| 4,732,592 | 3/1988 | Spengler | 55/356 |
| 4,804,392 | 2/1989 | Spengler | 55/356 |
| 4,900,342 | 2/1990 | Spengler | 55/473 X |
| 5,316,541 | 5/1994 | Fischer | 600/21 |

FOREIGN PATENT DOCUMENTS

| | | | |
|---|---|---|---|
| 5-231685 | 9/1993 | Japan | 454/187 |

*Primary Examiner*—Harold Joyce
*Attorney, Agent, or Firm*—Edwin E. Greigg; Ronald E. Greigg

[57] ABSTRACT

A clean air facility is proposed in which a clean air room is formed by welding the sides, ceiling, ducts and flooring together to avoid any friction movement between the wall and ceiling of the clean air room. A filter-blower is supported on a frame support outside of the room so that it is easier to service the filter-blower and it is easier to move the facility since the filter-blower can be detached and separately moved. The air from the filter-blower is directed directly into elongate cells in the ceiling from which the air is distributed via apertures in the ceiling evenly throughout the clean air room.

9 Claims, 4 Drawing Sheets

CLEAN AIR FACILITY

BACKGROUND OF THE INVENTION

This invention is directed to a clean air facility and more particularly to a clean air facility which is of a class 10 type or better, that is, one which produces a clean air throughput having less than 10 particles of a size 0.5 micron or greater per cubic foot of air.

Heretofore, clean air rooms have been of two main types: those which are fixed in place as well as those that are portable. Applicant has the following patents which are related to the present invention: U.S. Pat. Nos. 4,732,592; 4,804,392 and 4,900,342. Another prior art patent known to applicant is U.S. Pat. No. 4,304,224, which is also related to clean air facilities.

It has been determined that in order to provide a class 10 clean air facility friction of internal components used in construction must be held to a minimum; the air must be uniformly distributed. In most clean rooms air changes per hour are 100–200 ACPH (air changes per hour). But, in some cases a minimum number of air changes per hour are desirable and air changes per hour must be held to a minimum. In addition, it is desirable that the facility be transportable.

This combination of desired features has not been provided by the known prior art. For instance, the facility of U.S. Pat. No. 4,304,224 has many sources of friction which generate airborne particles that contaminate the air flow. The air is not uniformly distributed and has a maximum of 20 air changes per hour. The facility is not transportable and is specifically designed as a sterile chamber rather than as a clean air facility.

OBJECTS AND SUMMARY OF THE INVENTION

It is therefore a principal object of the invention to provide a clean air facility that has little, if any, sources of friction.

Another object is to provide a clean air facility that has a uniform air distribution throughout the facility.

Still another object is to provide a clean air facility in which all surfaces are welded together without the use of gaskets or joints which would generate airborne particles by friction.

Yet another object is to provide a separate air supply-filter system which can be moved independent of the clean air facility for portability.

A clean air facility is proposed in which a clean air room is formed by welding the sides, ceiling, and flooring together to avoid any friction movement between the wall and ceiling of the clean air room. A filter-blower is supported on a frame support outside of the room so that it is easier to service the filter-blower and it is easier to move the facility since the filter-blower can be detached and separately moved. The air from the filter-blower is directed directly into elongate cells in the ceiling from which the air is distributed via apertures in the ceiling evenly throughout the clean air room.

The invention will be better understood and further objects and advantages thereof will become more apparent from the ensuing detailed description of a preferred embodiment taken in conjunction with the drawings.

DETAILED DESCRIPTION

Figure 1:
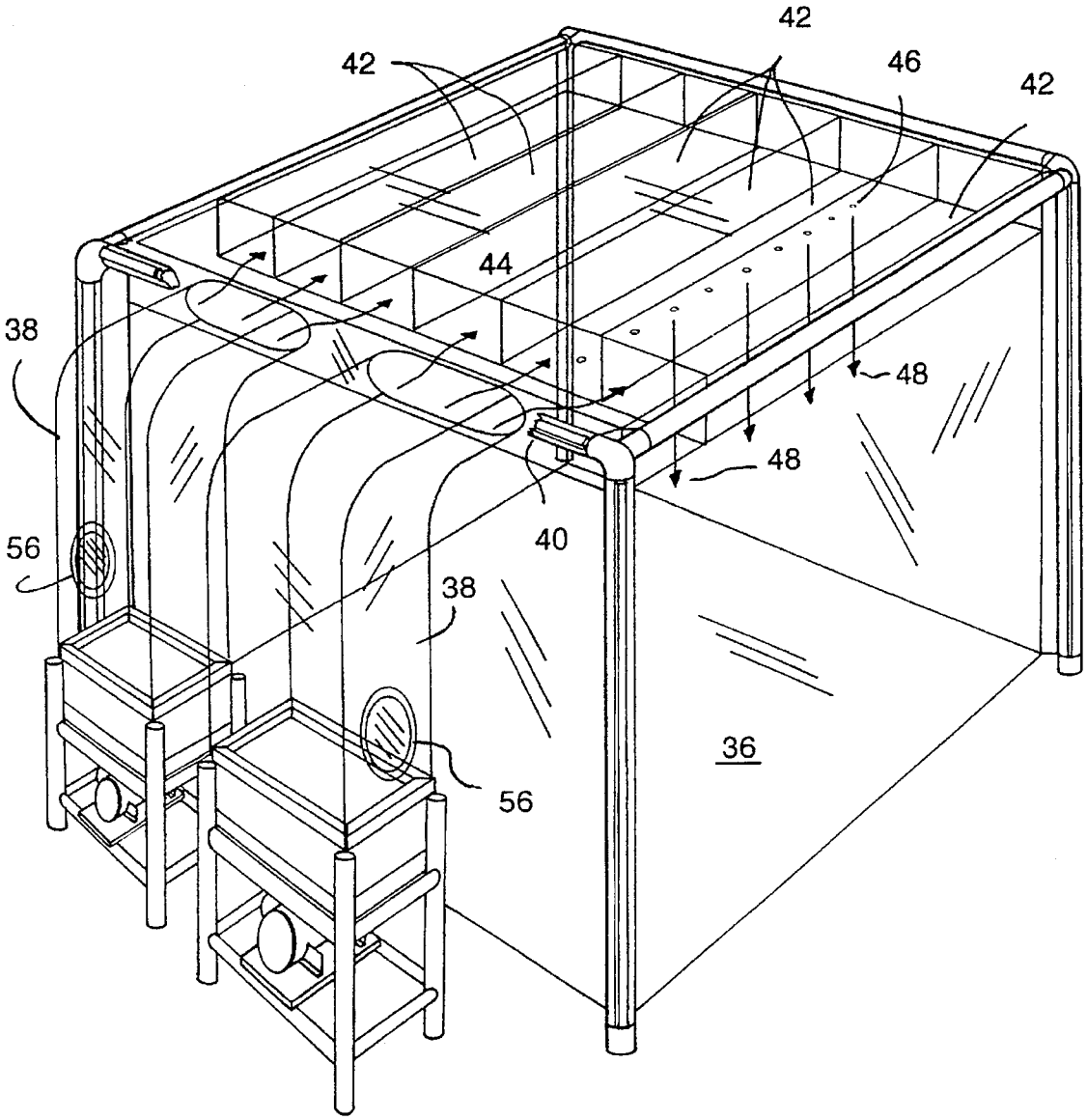
FIG. 1 illustrates a clean air facility in accordance with this invention.
Figure 2:
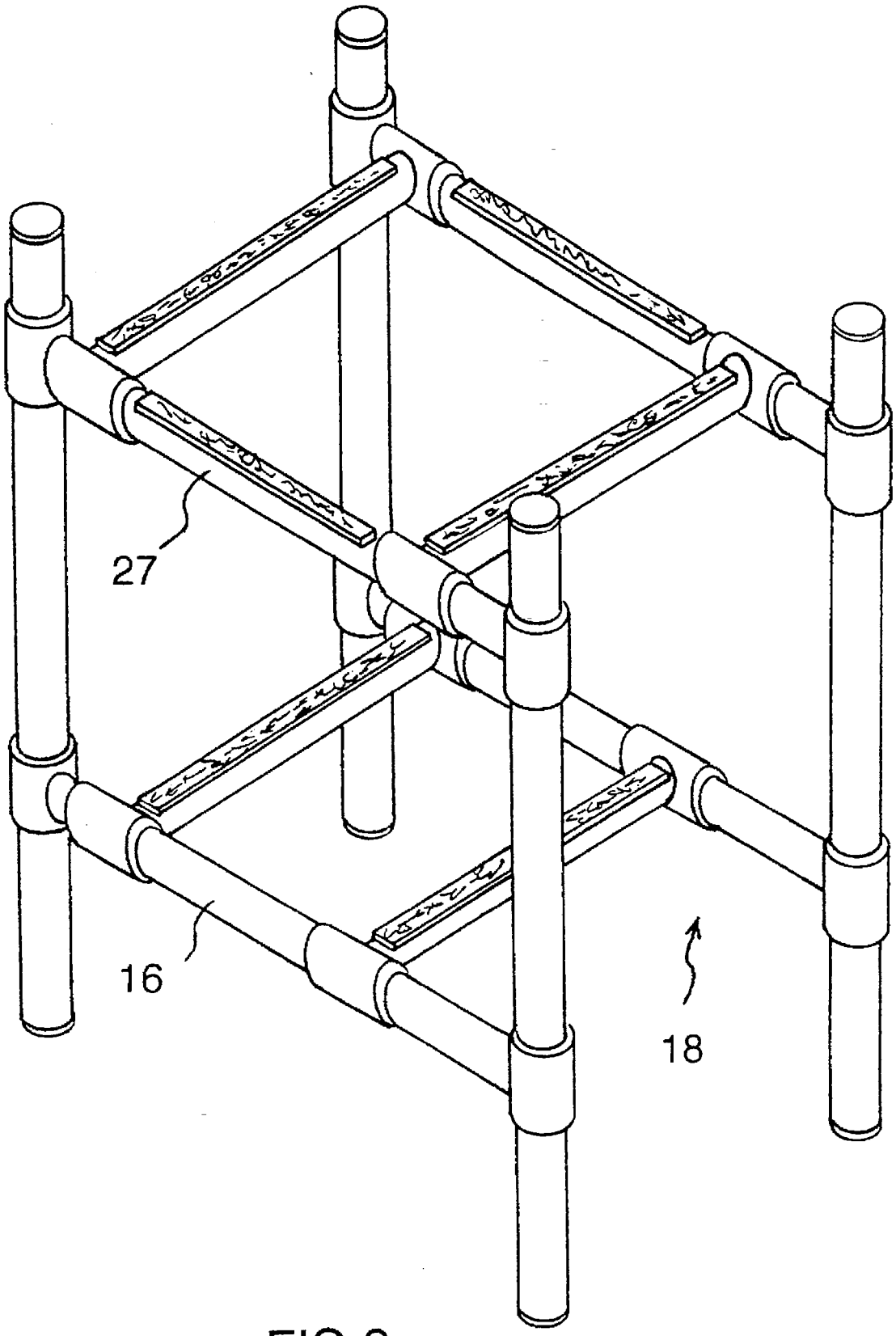
FIG. 2 illustrates a support for supporting a filter-blower unit.
Figure 3:
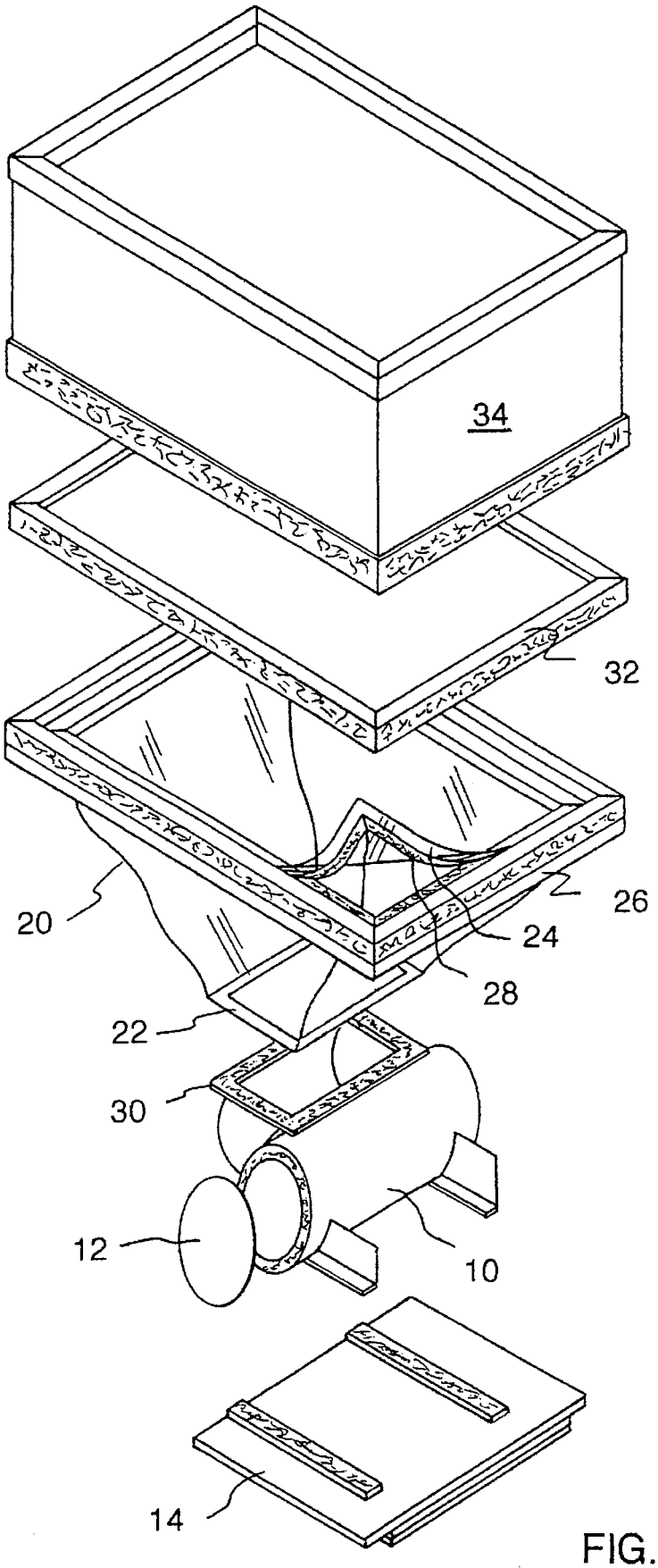
FIG. 3 illustrates an expanded view of the filter-blower unit.

Now referring to the drawings, wherein the same reference characters represent the same elements, there is shown in FIG. 1 a clean air facility according to this invention. The clean air facility includes a blower assembly, details of which are shown in FIG. 3, to which reference is now made.

The blower 10 is provided with a pre-filter 12 that filters the incoming air prior to reaching the blower 10. The blower 10 is secured onto a support pad 14 which is supported on a bottom section 16 of a filter-blower support 18. The pad 14 is secured to the support section 16 by the use of hook and loop fasteners, such as VELCRO®, on the support 16 and on the bottom of the pad 14. Air is drawn through the filter 12 and directed upwardly via a clear synthetic duct or air flow passage 20, which is of rectangular shape at its bottom end 22, the upper end 24 of which is secured to the lower end of a gasket 26 which sets on the upper support rods 27 of the support 18. The upper and lower ends of the flow passage 20 are secured in place by hook and loop fastener strips 28 and 30. A suitable gasket 32 is positioned between the gasket 26 to which the upper end of the air flow passage 20 is secured and the bottom of a HEPA filter 34. The gaskets 26 and 32 and the bottom edges of the HEPA filter are provided with hook and loop fastener strips on their outer surfaces for securing the gaskets and HEPA filter in place by wrapping the joints therebetween with hook and loop fasteners. In the areas in which the hook and loop fastener is applied a fine bead of silicone is applied to seal the connection and to prevent frictional movement of the parts.

Referring again to FIG. 1, the clean air facility as shown is provided with two side-by-side blower-filters, each of which are connected with the clean air room 36 by ducts 38 connected to an upper end wall 40 through which the filtered clean air flows. The ducts 38 are secured to the upper end wall and the air is directed from the ducts 38 into separate evenly divided cells 42 as shown by the arrows 44. The cells are between the outer upper surface of the clean air room and the ceiling of the room. The opening in the end wall to which the duct 38 is connected is substantially as large as the adjacent openings to the cells. The ceiling in the area of the cells 42 is provided with apertures 46 along the width and length of each cell through which the air is blown into the clean air room, as illustrated by arrows 48. Apertures in the ceiling through which air flows are known in the art and thus only a few of the plurality which would exist have been shown.

The room is formed of a synthetic material such as TEFLON, TEDLAR, MYLAR, KEVLAR, vinyl, etc. Applicant prefers the use of clear vinyl. A continuous weldment of vinyl forms the walls, ceiling cells and outer upper surface of the room and ducts. It is probably important to say ducts are part of complete weldment as duct joints and vibration contribute significantly to airborne particles released through friction. Therefore, there are no surfaces that will generate airborne particles by friction. The air will be distributed evenly about the room via the apertures in the ceiling below the cells 42. The bottom edges of the walls can be close to the floor surface to form a space completely about the room through which the air will flow from the room. A floor could be added and welded to the bottom edges of the walls to provide a fully enclosed room. In this case a vinyl strip door is provided opposite the blower filter through which air escapes from the room. Since the air will be escaping from the room via the vinyl strip door, no particulate matter will enter the room.

Figure 6:
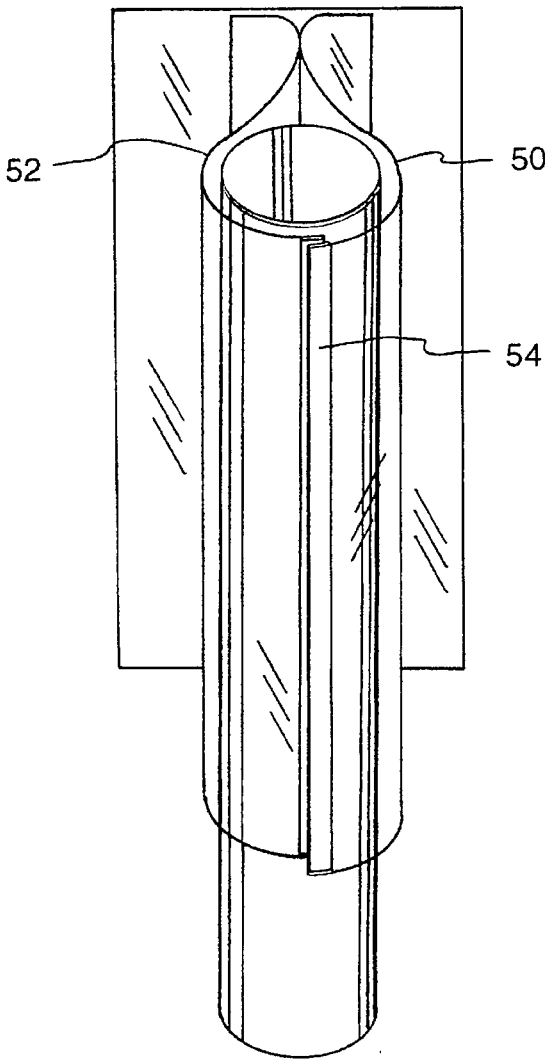
FIG. 6 illustrates a method of securing the clean air room to a supporting structure.
Figure 7:
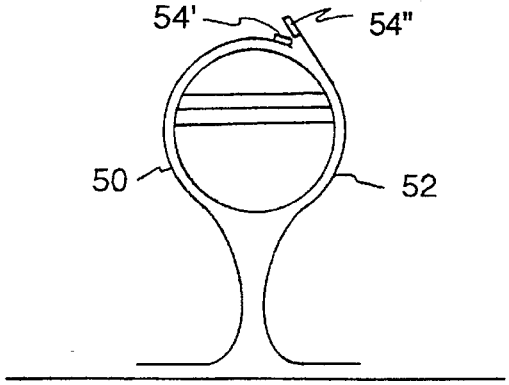
FIG. 7 illustrates a cross-sectional view of the subject of FIG. 6.

In order to prevent generation of airborne particles by friction, the corners of the room are secured to a supporting vertical and horizontal external frame work by use of vinyl pieces 50, 52, as shown in FIG. 6. As shown, one end of each piece is welded to the vinyl walls and ceiling along their length and the non-welded ends are fitted about the support structure and then secured along its length at 54 to encompass the support structure. The supporting vinyl pieces are welded onto the outside surfaces of the vinyl room walls and ceiling therefore no airborne particles will be formed on the inside by friction. In a preferred embodiment, and for ease of erection and disassembly, the region indicated as 54',54" could also comprise hook and loop fastener connections.

Figure 4:
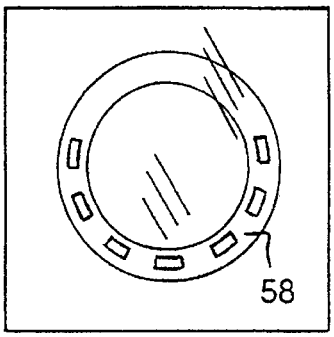
FIG. 4 illustrates a closed port hole.
Figure 5:
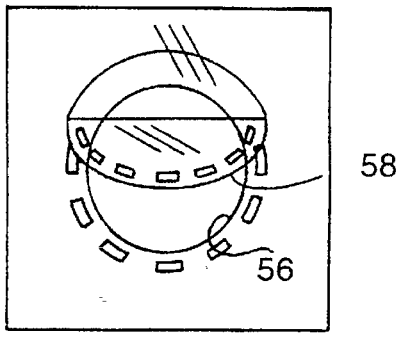
FIG. 5 illustrates an open port hole.

Each of the ducts 38 from the HEPA filter to the upper end of the clean air room are provided with port holes 56 which are closed by a flap 58 as shown in FIGS. 4 and 5. The port hole is provided with enclosed magnets along its circumference and the flap is provided with corresponding enclosed magnetically attractive material, such as magnets or iron filings, which secure the flap in place when the flap is lowered to meet with the port hole opening. Port holes such as shown in the duct could also be placed in the wall of the clean air room if desired. The flaps open outwardly, so any particles generated by friction are blown out of the airstream.

Since all joined surfaces of the room are welded together there is no generation of airborne particles by friction. Further since the clean air room is formed of clear vinyl, outside lighting can be provided which will avoid the need for an internal light source which could add heat to the room or create friction which may generate airborne particles.

Each of the filter-blower supporting structures 18 are supported on the floor outside of the room; therefore, they are easier to service and move should the room need to be moved. With the filter-blowers detached from the clean air room, both the clean air room and the filter blowers can be more easily moved, as two separate units.

It has been determined that a class 10 or better clean room can be achieved and maintained using this structure resulting in particles which do not exceed 0.5 microns at 50 air changes per hour. To achieve the same cleanliness conditions, prior art devices can only achieve this with 100 plus air changes per hour. Thus, one can see that the clean air room can be operated more efficiently for less cost.

In carrying out this invention, there are no surfaces that generate airborne particles by friction. The clean air room is more easily moved because the filter-blower is outside of the room. Since the air is blown directly into the air cells for distribution into the room there is very low resistance to the air flow. The clean room can be made from almost any synthetic clear material through which external light sources can be used. Therefore, no lighting is necessary within the confines of the room. Since the walls and ceiling are secured to the supports by parallel pieces of plastic, the walls and ceiling have a certain ability to slip on those supports in response to sharp lateral motions without tearing loose. Therefore, the assembly becomes earthquake resistant.

It should be apparent to one skilled in the art that an air lock room may be added so that a person may enter the clean air room without permitting any outside air to enter the clean air room. It should also be apparent that vinyl partitions may be provided within the clean air room to provide separate rooms or work areas. In that case, the partitions will necessarily be welded to the ceiling, walls and floor, if a floor is provided to avoid generation of airborne particles due to friction.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A clean air facility which comprises a clean air room, said clean air room is formed with sides and a ceiling by a suitable clear plastic or other synthetic sheets in which each sheet of the clear plastic are welded together to form said sides and ceiling to prevent any movement between the sheets and to prevent any airborne particles from forming due to friction along a joint, said clean air room includes parallel side-by-side air flow cells which are situated between said ceiling and an upper enclosed side of said clean air room, said air flow cells extend across a width and length of said ceiling of said clean air room and said ceiling includes apertures in an area of said cells through which air is forced into said clean air room from a filter-blower connected with said air flow cells.

2. A clean air facility as claimed in claim 1, in which said clear plastic sides and ceiling are secured to vertical and horizontal supports by a pair of plastic sheets, one end of each of said plastic sheets are welded to an outside surface of said clear plastic along a length of said vertical and horizontal supports, and another end of each of said pair of plastic sheets are wrapped around said vertical and horizontal supports and then said other end of each of said pair of plastic sheets are welded to each other about said vertical and horizontal supports whereby the sides and said ceiling of said clean air room are supported by such vertical and horizontal supports.

3. A clean air facility as claimed in claim 1, in which said clear plastic sides and ceiling are secured to vertical and horizontal supports by a pair of plastic sheets, one end of each of said plastic sheets are welded to an outside surface of said clear plastic along a length of said vertical and horizontal supports, and another end of each of said pair of plastic sheets are wrapped around said vertical and horizontal supports and said other ends of said pair of plastic sheets are provided with complemented set of hook and loop fasteners to retain them about said support whereby the sides and said ceiling of said clean air room are supported by said vertical and horizontal supports.

4. A clean air facility as claimed in claim 1, in which said filter-blower is secured to a support on an outside of said clean air room which support rests on a level with a bottom of said clean air room, said filter-blower is secured together to prevent movement of connected parts, an air flow duct is connected between said filter-blower and an upper end of one side of said clean air room, an opening in said upper end of one side of said clean air room is provided to which said duct is secured, said opening in said upper end of said clean air room being directly in alignment with at least some of said air flow cells and said opening has an outlet area substantially equal to inlet openings into said at least some of said air flow cells.

5. A clean air facility as claimed in claim 2, in which said filter-blower is secured to a support on an outside of said clean air room, said support rests on a level with a bottom of said clean air room, said filter-blower is secured together to prevent movement of connected parts, an air flow duct is connected between said filter-blower and an upper end of one side of said clean air room, an opening in said upper end of one side of said clean air room is provided to which said duct is secured, said opening in said upper end of said clean air room being directly in alignment with at least some of said air flow cells and said opening has an outlet area substantially equal to inlet openings into said at least some of said air flow cells.

6. A clean air facility as claimed in claim 1, in which said clean air room includes a plastic floor in which any separate parts of said plastic floor are welded together, and edges of said plastic floor are welded to bottom edges of said sides to provide a leak-free clean air room, and means are provided in at least one wall through which air passes from inside of the clean air room outside.

7. A clean air facility as claimed in claim 2, in which said clean air room includes a plastic floor in which any separate parts of said plastic floor are welded together, and edges of said plastic floor are welded to bottom edges of said sides to provide a leak-free clean air room, and means are provided in at least one wall through which air passes from inside of the clean air room outside.

8. A clean air facility as claimed in claim 3, in which said clean air room includes a plastic floor in which any separate parts of said plastic floor are welded together, and edges of said plastic floor are welded to bottom edges of said sides to provide a leak-free clean air room, and means are provided in at least one wall through which air passes from inside of the clean air room outside.

9. A clean air facility as claimed in claim 6, in which said clean air room includes a plastic floor in Which any separate parts of said plastic floor are welded together, and edges of said plastic floor are welded to bottom edges of said sides to provide a leak-free clean air room, and means are provided in at least one wall through which air passes from inside of the clean air room outside.

* * * * *